US008980061B2

(12) United States Patent
Vinje et al.

(10) Patent No.: US 8,980,061 B2
(45) Date of Patent: Mar. 17, 2015

(54) PROFILE BAR SCREEN FOR DIGESTER VESSELS

(75) Inventors: Mikael Vinje, Karlstad (SE); Jerk Söderman, Karlstad (SE)

(73) Assignee: Valmet AB, Sundsvall (SE)

( * ) Notice: Subject to any disclaimer, the term of this patent is extended or adjusted under 35 U.S.C. 154(b) by 0 days.

(21) Appl. No.: 14/371,468

(22) PCT Filed: Jan. 12, 2012

(86) PCT No.: PCT/SE2012/050018
§ 371 (c)(1),
(2), (4) Date: Sep. 1, 2014

(87) PCT Pub. No.: WO2013/105888
PCT Pub. Date: Jul. 18, 2013

(65) Prior Publication Data

US 2015/0020989 A1 Jan. 22, 2015

(30) Foreign Application Priority Data

Jan. 12, 2012 (WO) ..... PCT/SE2012/050018

(51) Int. Cl.
*D21C 7/00* (2006.01)
*D21C 7/14* (2006.01)

(52) U.S. Cl.
USPC ..... 162/251

(58) Field of Classification Search
USPC ..... 162/251, 55; 210/498, 499; 209/667, 209/666
See application file for complete search history.

(56) References Cited

U.S. PATENT DOCUMENTS

| | | | | | |
|---|---|---|---|---|---|
| 5,234,550 | A * | 8/1993 | Ekholm et al. | ..... | 162/251 |
| 5,827,401 | A | 10/1998 | Backlund | | |
| 6,039,841 | A * | 3/2000 | Hernesniemi | ..... | 162/251 |
| 6,344,112 | B1 * | 2/2002 | Hernesniemi | ..... | 162/251 |
| 6,889,851 | B1 * | 5/2005 | Isola | ..... | 209/667 |
| 2003/0095901 | A1 | 5/2003 | Isola | | |
| 2005/0284594 | A1 | 12/2005 | Nykanen | | |
| 2010/0276098 | A1 * | 11/2010 | Saetherasen | ..... | 162/237 |

FOREIGN PATENT DOCUMENTS

| | | |
|---|---|---|
| EP | 1316638 | 6/2003 |
| FI | WO0131117 | 5/2001 |
| SE | 100091 | 10/1940 |
| SE | WO9419533 | 9/1994 |
| SE | WO9516817 | 6/1995 |

OTHER PUBLICATIONS

Page A537, Chemical Pulping, book 6A (1999) ISBN 952-5216-06-3, (Fapet Oy, PO Box 146, FIN-00171 Helsinki, Finland).

* cited by examiner

*Primary Examiner* — Mark Halpern
(74) *Attorney, Agent, or Firm* — Rolf Fasth; Fasth Law Offices

(57) ABSTRACT

The improved profile bar screen is for draining treatment liquor from a suspension of comminuted cellulose material and treatment liquor in an essentially cylindrical digester vessel. The profile bar screen is designed with horizontal support arches that have expansion slots allowing the otherwise rigid structure of the support arches to flex and adapt to any unevenness of the vessel wall, thus allowing support shoulders to rest against the inside of the vessel wall.

9 Claims, 6 Drawing Sheets

PROFILE BAR SCREEN FOR DIGESTER VESSELS

PRIOR APPLICATION

This application is a 371 of PCT/SE2012/050018 filed 12 Jan. 2012

FIELD OF THE INVENTION

The present invention relates to a profile bar screen according to the preamble of claim 1.

A profile bar screen is used for draining treatment liquor from a suspension of comminuted cellulose material and treatment liquor in an essentially cylindrical digester vessel. This type of profile bar screen is used particularly in continuous digester vessels for producing pulp. Such a profile bar screen can be utilized in new reactors built, or used as spare part in old digesters where existing screen plates needs replacement or if increased withdrawal capacity is needed with larger screen area.

BACKGROUND OF THE INVENTION

Today, continuous digesters for instance comprise substantially cylindrical pressure vessels arranged in an upright position. Pressure vessels of continuous pulp digesters are remarkably high, and their diameter can be several meters. For instance, the diameter of the bottom part of a pressure vessel may be 4 m to 15 m, all depending upon production capacity of the digester.

The diameter of such a pressure vessel is usually smaller at the top end of the digester than at its bottom end. However, the diameter of the digester is typically arranged to increase at certain positions in step-outs during the cooking process by means of one or more conical transition sections. The exact positions are defined by process-specific technical grounds and where a change of treatment liquor needs to be made, using withdrawal or extraction screens at these positions. Screens are usually mounted below the above-mentioned step-outs.

Due to the considerable size of a pressure vessel, deviations from theoretical shapes of a cylinder produced during the manufacture of the pressure vessel are significant. The deviations from the intended circular cross-section cause many problems. One problem arises, for instance, when the inner surface of the pressure vessel is provided with the screens required. Besides these deviations of the cylindrical shape from manufacturing are the inside of the digester wall exposed to both erosion and formation of deposits during operation of the digester.

Conventionally, this type of screens are mounted so that the step-out which increases the diameter of the pressure vessel is provided with a screen surface below the step-out such that the internal diameter of the vessel above the step-out is the same or smaller than the internal diameter at the screen area, and below a screen surface is the pulp column allowed to expand in a step-out from the screen area and towards the inside of the pressure vessel. This step-out below a screen surface is made in order to allow the chip column to expand as it may have been compacted over the screen surface during treatment liquor withdrawal. If more than one screen row is arranged in connection with such a step-out is also a smaller step-out arranged between a first upper screen row and a second screen row below, allowing the pulp column to expand and thus improve withdrawal capacity in the second screen row.

Forces directed to the surface of screens are usually arranged to be transmitted to the cover of the pressure vessel by means of two kinds of support system.

The first kind of support system is used preferably in sturdy self supporting screens where support only is obtained by a frame bed surrounding a rectangular screen area This kind of support system has preferably been used for profile bar screens. By such support system could the withdrawal space behind the screens collecting the withdrawn treatment liquor avoid any obstructions which may accumulate deposits, and the withdrawal flow of treatment liquor could be maintained at full capacity over time.

The second kind of support system, preferably used for slotted screen plates, are support rods, i.e.

bars of specific length fixed to the screen plate, arranged between the screen plate and the inside wall of the pressure vessel. This second kind of support system use a multitude of support rods each having to be adjusted to the specific curvature of the vessel wall in order to obtain a support. The asymmetry of the inside wall of the digester's pressure vessel tend to cause problems. Due to the deviations of the cylindrical shape of the pressure vessel, a considerable number of support rods are not supported onto the vessel wall, but at their one end, the support rods are hanging freely in the liquor collection chamber formed behind the screen, which collection chamber is formed between the screen and the interior wall of the pressure vessel. The object of transmitting forces directed to the screen construction to the inner wall of the digester vessel is thus not always achieved by using support rods. Because of the disadvantageous force stress the support rods bend and the screen twists, even breaks. In order to solve this problem could these support rods be made adjustable in order to avoid this problem, which requires a time consuming procedure for adjusting each individual support rod. Installation and replacement of such screen plates with adjustable support rods will be a rather time consuming process.

Examples of above described solutions could be found in prior art patents.

In US2003/0095901 is shown a support system for screen plate wherein adjustable support pins are used.

In US 2005/0284594 is shown a support system for sturdy self supporting profiled bar screens using circular profile bar rods. The profile bar screen is supported by a frame bed surrounding the screen, and horizontal support arches having integrated support shoulders are located at a distance from the digester wall in order to allow a certain ability to move. Similar profiled bar screens is also shown in U.S. Pat. No. 6,889,851 having adjustable support pins.

In U.S. Pat. No. 5,827,401 is shown yet a support system for sturdy self supporting profiled bar screens using T-shaped profile bar rods, but applied in circular screens. In this design is the force on the screen profile bars transmitted first to a support arch behind rods, and then further to a frame bed located around the circular screen.

In WO95/16817 is yet another support system for sturdy self supporting profiled bar screens using T-shaped profile bar rods, but here using horizontally oriented profile bar rods.

Profile bar screens are most often preferred as the total withdrawal area (I.e. slot area) are larger than for slotted screen plates, hence the withdrawal capacity per surface area could be higher. However, these profile bar screens are most often made with a sturdy self supporting design where all the force is transmitted to digester wall by a supporting frame bed. One more advantage with profile bar screens is that if these have vertical profile bars with vertical slots in-between, could the slots be subjected to a continuous rubbing action from the descending pulp column keeping the slots free from any obstructions, and lower ends of these profile bars could have an unobstructed slot ending allowing any chip fragments caught in a slot from escaping out and away from the slots by the pushing action from the pulp column.

In digesters having screen areas equipped with screen plates and a multitude of support rods between screen plate and digester vessel wall, are no sturdy frame bed structure at hand which may be used to install sturdy self supporting profiled bar screens. If a profiled screen bar is to be installed in such digester it must have the same support structure with a multitude of support rods, and installation and adaption of each individual support rod becomes time consuming and thus costly.

BRIEF DESCRIPTION OF THE INVENTION

It is an object of the present invention to prevent the problems in existing solutions when installing profile bar screens in cylindrical digester vessels, such that a still sturdy profile bar screen might be installed quicker and with optimum load support. According to the invention the profiled bar screen could be installed as a replacement screen also in digesters where originally slotted screen plates have been used, and where load support instead has been obtained with a multitude of support pins on the backside of the slotted screen plates, thus having a weaker surrounding frame bed.

Previously, when replacing slotted screen plates with profiled bar screens, the entire surrounding frame bed had to be rebuilt, as the profiled bar screens most often had its only load support in surrounding frame bed.

In order to enable installation also of profile bar screens in screen beds with weaker screen frames, some profiled bar screen also had a multitude of support pins on the backside of the profiled bar screen. Those support pins typically located between support arches and inside of digester wall. But this usage of support pins had the inherent disadvantage with a tedious and time consuming task to adapt the length of each individual support bar. Replacement of digester screens are typically installed during shut down of the digester and the entire pulp production line, which calls for a design enabling an efficient and fast process as any hour of shut-down causes great losses in income from pulp sales.

According to the invention is thus provided for a profile bar screen for draining treatment liquor from a suspension of comminuted cellulose material and treatment liquor in an essentially cylindrical digester vessel, said profile bar screen being arranged inside the outer wall of the digester vessel forming a withdrawal chamber between the wall of the digester vessel and the profile bar screen, the profile bar screen comprising:

vertical profile bar elements facing the suspension of comminuted cellulose material, said vertical profile bars arranged in parallel to each other and forming a withdrawal slot for treatment liquor between neighboring profile bars;

several horizontal support arches having vertical mounting slots for holding a profile bar element in said mounting slots, the horizontal support arches having integrated support shoulders resting against the inside of the outer wall of the cylindrical digester vessel;

said horizontal support arches being equipped with additional expansion slots having an open end facing towards the interior of the digester vessel and a dosed end in the area of a support shoulder, allowing a flexibility of the horizontal support arches such that support shoulders may rest against the wall of the digester vessel despite any local deviations from a perfect cylindrical shape of the digester vessel wall.

This basic design will establish a hinge-like function of the support arch enabling it to flex at these local positions, allowing the support shoulders to make contact with the inside of the digester vessel despite any unevenness of a true cylindrical shape of the vessel.

Further, according to a preferred embodiment is the profile bar screen having expansion slots with a depth trough the horizontal support arches exceeding the depth of the horizontal support arches where no support shoulder is located radially outside of the support arches. This will enable a better hinge-like function in this area allowing the support arch to flex.

In yet a further embodiment is the profile bar screen having a dept h of the expansion slots exceeding 50% of the total depth of the horizontal support arches, as counted from the inwardly facing surface of the support arches and to the outwardly facing surface of the support shoulder of the support arches. This will further establish a hinge-like function in this area allowing the support arch to flex.

Preferably is the dosed end of the expansion slot having a widened and essentially circular slot part with a radius exceeding 5 millimeter. This will solve problem with high local stress forces that could initiate crack growth.

Alternatively the expansion slot could have a width being substantially constant before mounting the profile bar screen in said digester vessel, or the expansion slot could have a larger width at the open end facing towards the interior of the digester vessel than the width at the dosed end before mounting the profile bar screen in said digester vessel. The alternative with increasing slot width is preferably chosen when the cylindrical shape of the digester deviates more from a strict cylindrical form.

While the invention could be used with different types of bar profiles it preferably make use of profile bar elements having a T-shaped form, with bottom part of the T-shape mounted in the vertical mounting slots of the horizontal support arches for holding a profile bar element in said mounting slots, and with the upper flat face of the T-shaped vertical profile bar facing the inside of the treatment vessel and the suspension of comminuted cellulose material contained therein.

Alternatively the invention may use vertical profile bar elements having a closed Y-shaped form, with bottom part of the Y-shape mounted in the vertical mounting slots of the horizontal support arches for holding a profile bar element in said mounting slots, and with the upper flat face of the dosed Y-shaped vertical profile bar facing the inside of the treatment vessel and the suspension of comminuted cellulose material contained therein.

In yet an alternative embodiment the invention may use

BRIEF DESCRIPTION OF THE FIGURES

In the following a preferred embodiment of the invention will be described with reference to the attached drawing, in which FIG. 1 shown a continuous digester with cut-away sections in 2 screen areas of the digester.

DETAILED DESCRIPTION OF THE PREFERRED EMBODIMENT

Figure 1:
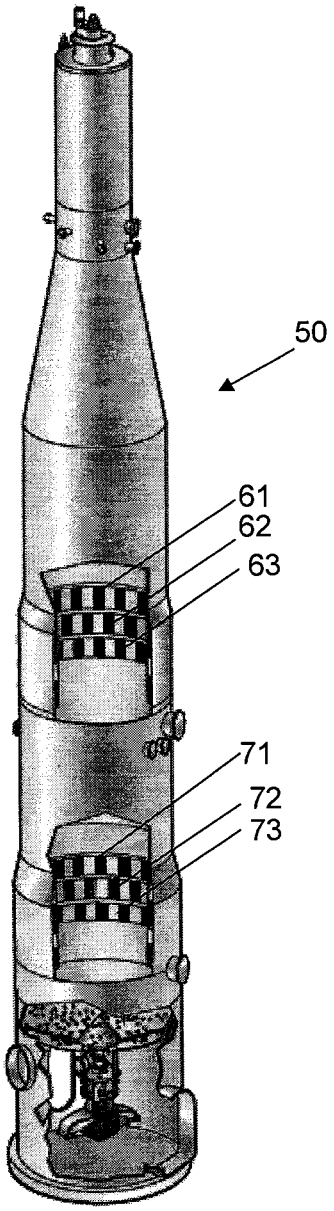

In FIG. 1 is shown a tall and cylindrical continuous digester of a conventional design, with in feed of comminuted cellulose material in upper part and out feed of cooked pulp in bottom. The digester is shown with cut-away sections in 2 screen areas of the digester. In the upper cut-away section are three screen rows shown. Here is the screen area designed with the "checkered" screen area, i.e. with alternating blind plates and screens 61, 62, 63 in each screen row.

The same "checkered" screen area is shown in the lower cut-away section, also with 3 screen rows with alternating blind plates and screens 71, 72, 73 in each screen row.

Essentially the same withdrawal capacity could be obtained with such "checkered" screen if profile bar screens are used instead of slotted plates, as profile bar screens have larger open slot area The main problem with withdrawal capacity lies in the flow resistance trough the chip (or pulp) bed inside the digester, which could be very high in digesters with a diameter of 10-14 meter. So, a profile bar screen with "checkered" screen area could have same withdrawal capacity as a screen row with slotted screen plates all around the circumference.

Figure 2:
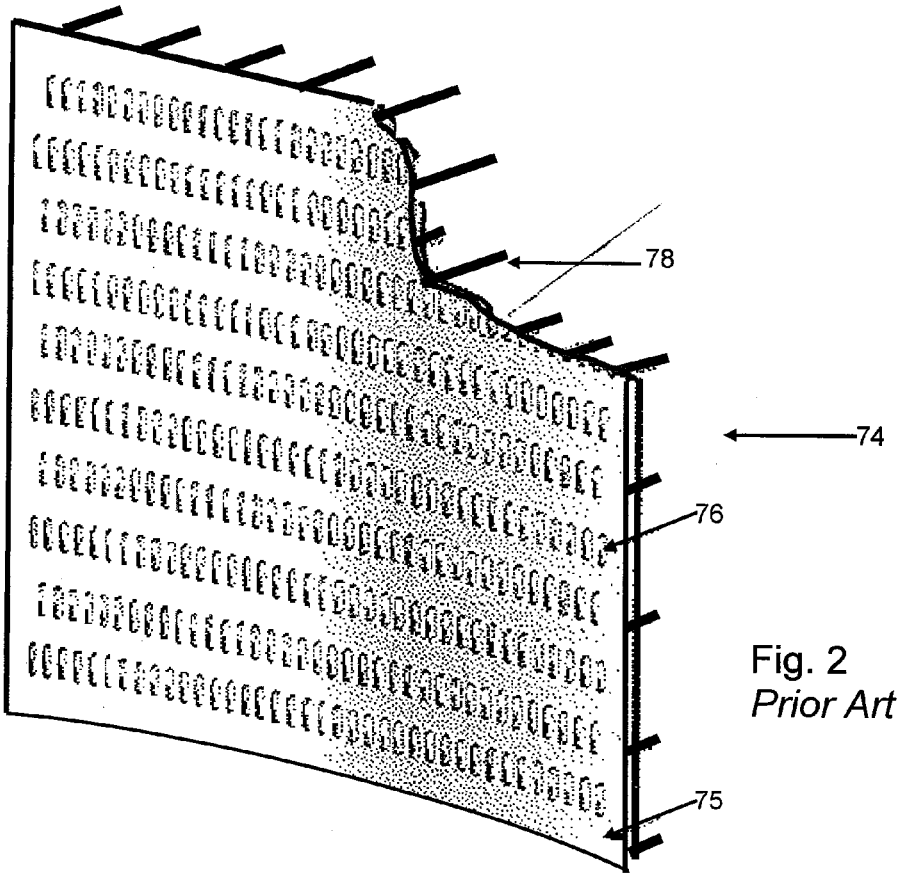
Fig. 2 Prior Art
FIG. 2 shows a slotted screen plate according to prior art.

In FIG. 2 is shown a conventional slotted screen plate 74 according to prior art. A metal plate 75 is equipped with withdrawal slots 76 which are made by either machine milling or water cutting jet technique. The entire screen plate is only supported by a multitude of support rods 78.

Figure 3:
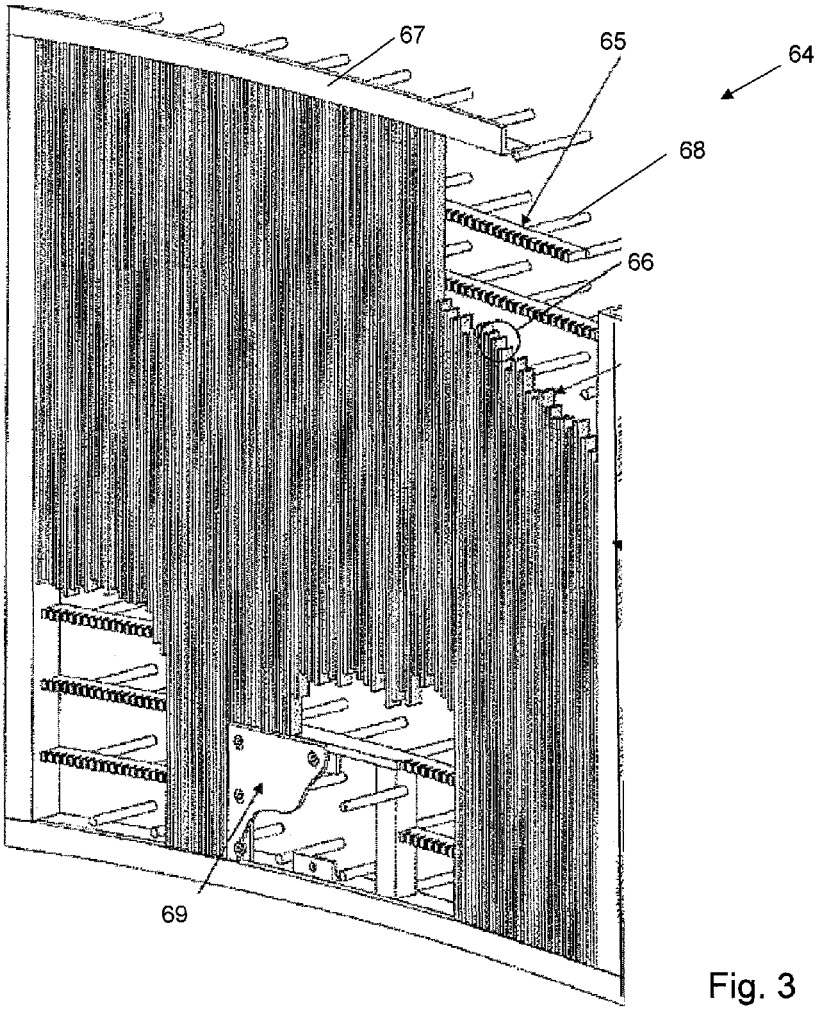
Fig. 3 Prior Art
FIG. 3 shows a profile bar screen according to prior art.

In FIG. 3 is shown a conventional profile bar screen 64 according to prior art. Profile bars 66 are supported by horizontal support arches 65, which in turn are supported by a multitude of support rods 68. Here is also shown a dean-out plate 69, which could be opened in order to dean out lower part of screen assembly. Both these type of screens are shown on page A537 in "Chemical Pulping", book 6A (1999), ISBN 952-5216-06-3, as screens promoted by Ahlstrom Machinery (now Andritz).

Figure 4:
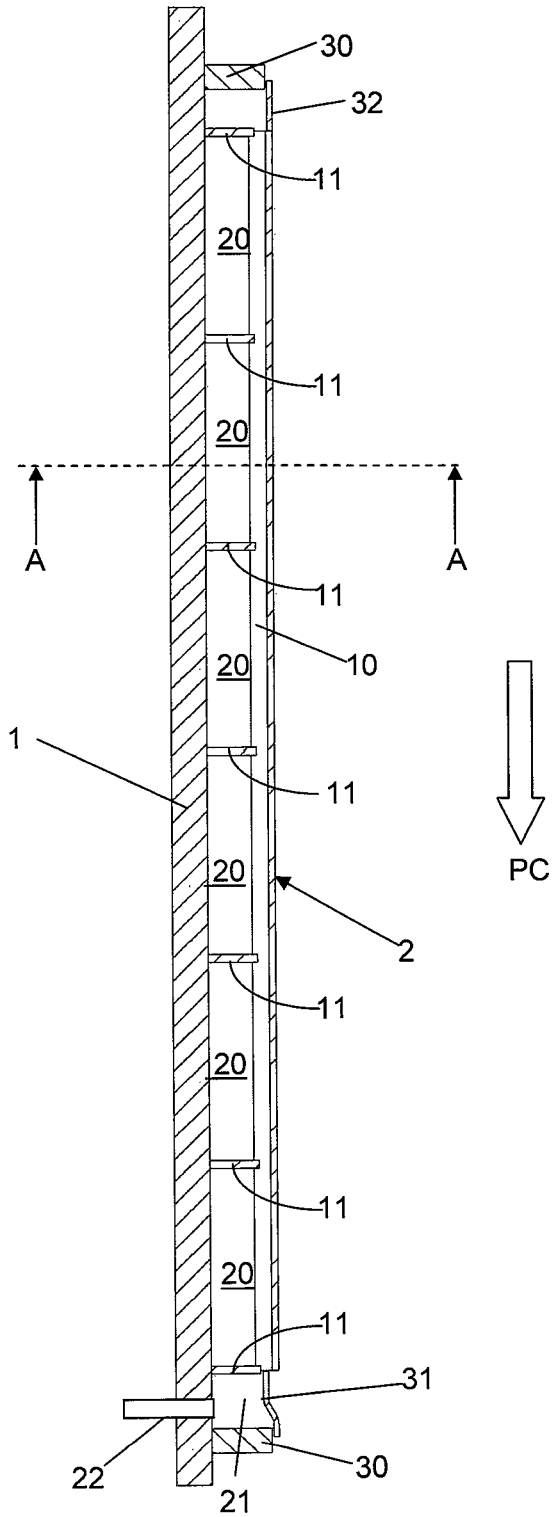
FIG. 4 shows the profile bar screen in a vertical section view.

In FIG. 4 is shown the profile bar screen according to the invention as mounted in a continuous digester. The digester wall 1 is the actual pressure vessel wall and inside of the wall is the profile bar screen 2 located with vertical profile bar elements 10 facing the suspension of comminuted cellulose material as it descends down through the digester as a pulp column in the downwards direction PC. The vertical profile bar elements 10 are mounted on several horizontal support arches 11 located preferably at a set vertical distance between each support arch 11. Thus, the force upon the profile bar screen from the pulp column is first exposed to the profile bar elements 10 and via support arches 11 to the inside of the digester wall 1.

As indicated could a blind plate 32 be located above the screen bar elements 10, supported on a horizontal thrust beam 30. The upper blind plate 32 has its inwardly facing surface located flush with the inwardly facing surface of the screen bar elements, allowing the descending pulp column to descend without any obstructions to the bar screen area.

Below the profile bar elements 10 is a guide plate 31 mounted, which in its upper part has a retracted position allowing any chip fragments caught in slots between the profile bar elements from being pushed out from the slots as the pulp column descends.

The withdrawn treatment liquor is collected in a number of withdrawal chambers 20 between the profile bar elements 10 and the inside of the digester wall. The withdrawal chambers 20 are all in fluid communication with each other and withdrawn treatment liquor will finally be collected in a header chamber 21 located below chambers 20 before being withdrawn from the digester trough an outlet 22.

Figure 5:
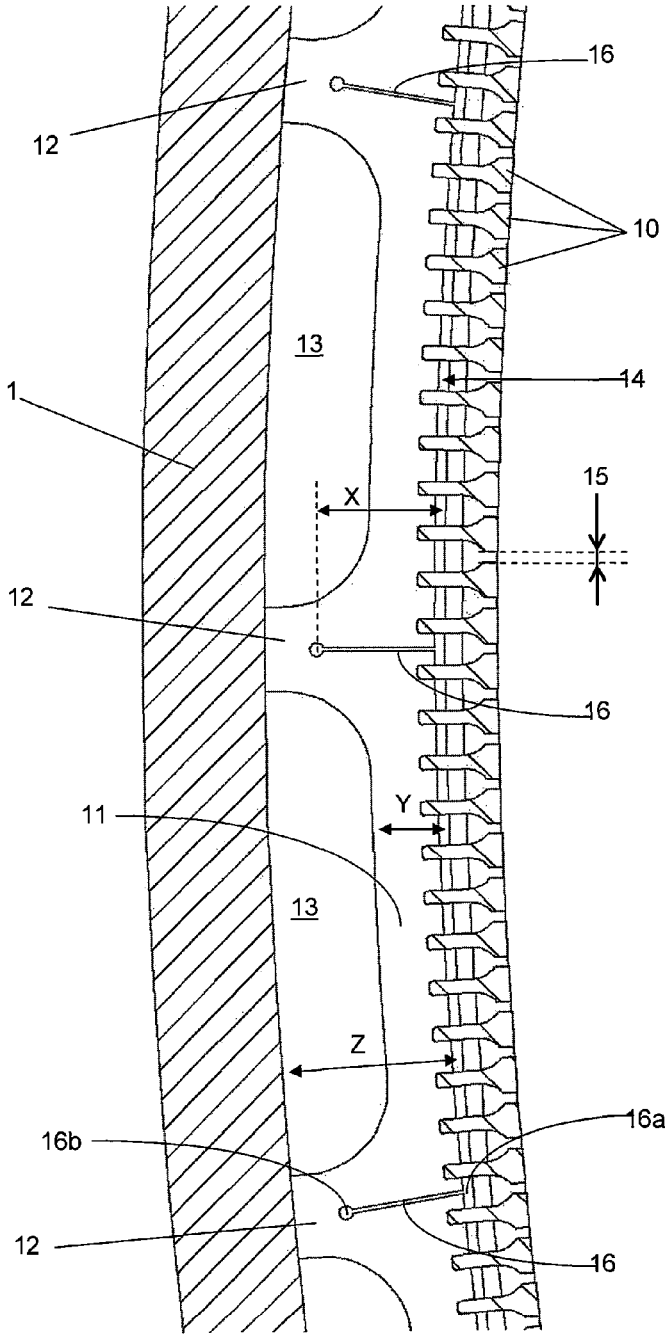
FIG. 5 shows the profile bar screen as seen in section A-A in FIG. 4.

The inventive features of the profile bar screen are shown in FIG. 5. The support arches 11 has on the surface 14 facing the interior of the digester vertical mounting slots for holding a profile bar element 10 (only 3 profile bar elements numbered in figure) in said mounting slots. The profile bar elements have a T-shaped form. The bottom part of the T-shaped profile bar element is mounted in the vertical mounting slots of the horizontal support arches, with the upper flat face of the T-shaped vertical profile bar facing the inside of the treatment vessel and the suspension of comminuted cellulose material contained therein.

A withdrawal slot 15 is thus formed between profile bar elements 10. The screen slot size is varying from some 5-6 mm in upper part of digester and down to some 3 mm in lower part of digester, as the cellulose material is subjected to increased delignification and softening during cooking in the digester and slot size needs to be smaller in the final phases of the cook.

The horizontal support arches 11 further have integrated protruding support shoulders 12 resting against the inside of the outer wall 1 of the cylindrical digester vessel, and in FIG. 5 are 3 such support shoulders 12 shown, each located some distance apart creating an open flow channel 13 connecting the withdrawal chambers 20 to each other.

According to the invention are the horizontal support arches 11 equipped with additional expansion slots 16 having an open end 16*a* facing towards the interior of the digester vessel and a dosed end 16*b* in the area of a support shoulder 12, allowing a flexibility of the horizontal support arches such that all support shoulder may rest against the wall of the digester vessel despite any local deviations from a perfect cylindrical shape of the digester vessel wall.

In the shown embodiment could some 12 profile bar elements be mounted between 2 neighboring expansion slots, but could be as few as 10 or as many as 20. The non flexing part of the support arch would thus hold the profile bar elements fixed in relation to each other and the withdrawal slot 15 thus kept constant. The withdrawal slot 15 coincident with the expansion slot 16 would instead allow some alteration of the slot width as the support arch will flex. However, the impact of this alteration is low, and if for example 10 profile bar elements are mounted between two expansion slots will only 10% of slot area be subjected to alteration due to flexing of the support arch. The relative alteration of individual slots will decrease with less profile bar elements between expansion slots as flexing due to uneven cylindrical form of vessel will be distributed over more expansion slots.

The expansion slots preferably has a depth X trough the horizontal support arches exceeding the depth Y of the horizontal support arches 11 in the area of the support arches wherein no support shoulder is located radially outside of the support arches.

The length X of the expansion slots preferably exceeds 50% of the total depth Z of the horizontal support arches 11, as counted from the inwardly facing surface 14 of the support arches 11 and to the outwardly facing surface of the support shoulder 12 of the support arches 11.

The depth of the support shoulder (Z-Yin FIG. 5) could vary depending upon the depth of the chambers 20 in each individual digester.

In order to avoid stress cracking due to local stress load as the support arch 11 will flex is the dosed end 16*b* of the expansion slot preferably widened with an essentially circular slot part with a radius exceeding 4 millimeter as shown in principle in FIG. 5.

The expansion slot 16 could have a width being substantially constant before mounting the profile bar screen in said digester vessel or alternatively have a larger width at the open end 16*a* facing towards the interior of the digester vessel than the width at the dosed end 16*b* before mounting the profile bar screen in said digester vessel. The alternative with increasing width towards open end 16*a* could preferably be used when the digester vessel is expected to have a form that deviates more from a perfect cylindrical form, thus needing more flexing in the support arch 11. Thus, with increasing width the slot could be some 1 mm at closed end 16*b* and some 2-4 mm at open end 16*a*.

It is to be understood that the above description and the related figures are only intended to illustrate the present solution. Thus, the solution is not restricted only to the embodiment described above and defined in the claims, but many different variations and modifications, which are possible within the scope of the idea defined in the attached claims, will be obvious to a person skilled in the art.

Thus the profile bar screen may preferably be used in other cylindrical digesters, either in continuous or batch digesters with a cylindrical form. In FIGS. 6*a*-6*d* are shown different types of profile bars that could be used.

Figure 6A:
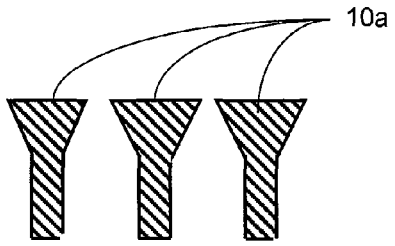
FIG. 6*a-d* shows different profile bars usable in the claimed invention.
Figure 6B:
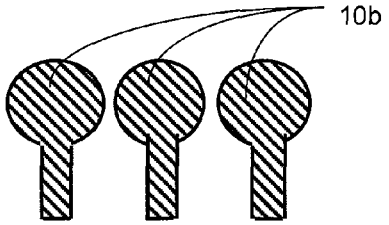

In FIG. 6*a* is shown a profile bar with vertical profile bar elements having a closed Y-shaped form, with bottom part of the Y-shape mounted in the vertical mounting slots of the horizontal support arches for holding a profile bar element in said mounting slots, and with the upper flat face of the dosed Y-shaped vertical profile bar facing the inside of the treatment vessel and the suspension of comminuted cellulose material contained therein.

In FIG. 6 b is shown a profile bar with vertical profile bar elements 10*b* having a circular form facing the interior of the digester, with an integrated flat bar portion at its bottom part mounted in the vertical mounting slots of the horizontal support arches for holding a profile bar element in said mounting slots, and with the upper faces of the circular bars facing the inside of the treatment vessel and the suspension of comminuted cellulose material contained therein.

Figure 6C:
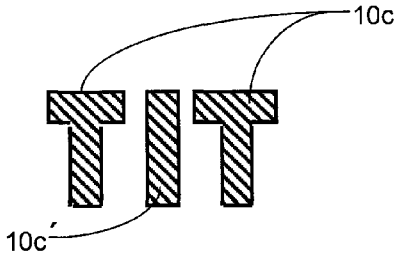

In FIG. 6*c* is shown a profile bar with vertical profile bar elements 10*c* having a T-shaped form, with bottom part of the T-shaped bar mounted in the vertical mounting slots of the horizontal support arches for holding a profile bar element in said mounting slots, and with the upper flat face of the T-shaped vertical profile bar facing the inside of the treatment vessel and the suspension of comminuted cellulose material contained therein. But in this embodiment is each second bar element a flat bar element 10*c'*.

Figure 6D:
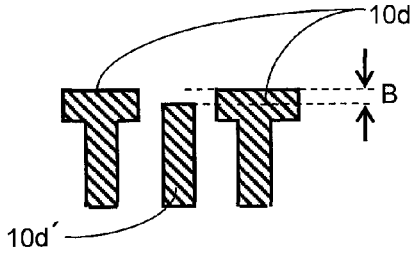

In FIG. 6*d* is shown an alternative profile bar arrangement according to FIG. 6*c*, but where each second bar element is recessed a distance B from the upper flat face of neighboring T-shaped bar elements.

While the present invention has been described in accordance with preferred compositions and embodiments, it is to be understood that certain substitutions and alterations may be made thereto without departing from the spirit and scope of the following claims.

We claim:

1. A profile bar screen for draining treatment liquor from a suspension of comminuted cellulose material and treatment liquor in an essentially cylindrical digester vessel, said profile bar screen being arranged inside the outer wall of the digester vessel forming a withdrawal chamber between the wall of the digester vessel and the profile bar screen, the profile bar screen comprising:

vertical profile bar elements facing the suspension of comminuted cellulose material, said vertical profile bars arranged in parallel to each other and forming a withdrawal slot for treatment liquor between neighboring profile bars;

several horizontal support arches having vertical mounting slots for holding a profile bar element in said mounting slots, the horizontal support arches having integrated support shoulders resting against the inside of the outer wall of the cylindrical digester vessel;

said horizontal support arches being equipped with additional expansion slots having an open end facing towards the interior of the digester vessel and a closed end in the area of a support shoulder, allowing a flexibility of the horizontal support arches such that support shoulders rest against the wall of the digester vessel despite any local deviations from a perfect cylindrical shape of the digester vessel wall; and the expansion slots having a depth (X) through the horizontal support arches exceeding a depth (Y) of the horizontal support arches where no support shoulder is located radially outside of the support arches.

2. A profile bar screen as claimed in claim 1, wherein the depth (X) of the expansion slots exceeds 50% of the total depth (Z) of the horizontal support arches, as counted from the inwardly facing surface of the support arches and to the outwardly facing surface of the support shoulder of the support arches.

3. A profile bar screen as claimed in claim 2, wherein the closed end of the expansion slot has a widened and essentially circular slot part with a radius exceeding 5 millimeters.

4. A profile bar screen as claimed in claim 2, wherein the expansion slot has a width being substantially constant before mounting the profile bar screen in said digester vessel.

5. A profile bar screen as claimed in claim 2, wherein the expansion slot has a larger width at the open end facing towards the interior of the digester vessel than the width at the closed end before mounting the profile bar screen in said digester vessel.

6. A profile bar screen as claimed in claim 1, wherein the vertical profile bar elements have a T-shaped form, with bottom part of the T-shape mounted in the vertical mounting slots of the horizontal support arches for holding a profile bar element in said mounting slots, and with the upper flat face of the T-shaped vertical profile bar facing the inside of the treatment vessel and the suspension of comminuted cellulose material contained therein.

7. A profile bar screen as claimed in claim 6, wherein each second vertical profile bar element is a flat bar element.

8. A profile bar screen as claimed in claim 1, wherein the vertical profile bar elements have a closed Y-shaped form, with bottom part of the Y-shape mounted in the vertical mounting slots of the horizontal support arches for holding a profile bar element in said mounting slots, and with the upper flat face of the closed Y-shaped vertical profile bar facing the inside of the treatment vessel and the suspension of comminuted cellulose material contained therein.

9. A profile bar screen as claimed in claim 1, wherein the vertical profile bar elements having a circular form facing the interior of the digester, with an integrated flat bar portion at its bottom part mounted in the vertical mounting slots of the horizontal support arches for holding a profile bar element in said mounting slots, and with the upper faces of the circular bars facing the inside of the treatment vessel and the suspension of comminuted cellulose material contained therein.

* * * * *